US005406985A

United States Patent [19]

Christe

[11] Patent Number: 5,406,985

[45] Date of Patent: Apr. 18, 1995

[54] SERIES-SHED LOOM WITH ADJUSTABLE AIRJET DELIVERY SYSTEM FOR DIFFERENT LOOM WIDTHS

[75] Inventor: Marcel Christe, Rüti, Switzerland

[73] Assignee: Gebrueder Sulzer Aktiengesellschaft, Winterthur, Switzerland

[21] Appl. No.: 95,329

[22] Filed: Jul. 21, 1993

[30] Foreign Application Priority Data

Aug. 28, 1992 [EP] European Pat. Off. ..... 92810663

[51] Int. Cl.[6] ..... D03D 47/30

[52] U.S. Cl. ..... 139/11; 139/28

[58] Field of Search ..... 139/11, 194, 450, 435.6, 139/188 R, 435.3, 28, 429, 435.2

[56] References Cited

U.S. PATENT DOCUMENTS 4,586,541 5/1986 Steiner ..... 139/28 X
5,146,955 9/1992 Steiner et al. ..... 139/11 X

FOREIGN PATENT DOCUMENTS 0049297 4/1982 European Pat. Off. .
0079999 6/1983 European Pat. Off. .
0143859 6/1985 European Pat. Off. .

*Primary Examiner*—Andrew M. Falik
*Attorney, Agent, or Firm*—Townsend and Townsend Khourie and Crew

[57] ABSTRACT

A rotor for a series-shed loom is furnished, with relay system jets (3). These relay system jets (3) are located inside the rotor, and are supplied with compressed air by an air distribution system (10) via delivery stations. The delivery stations are distributed in the axial direction in order to produce a travelling field (22) relative to the loom rotor. At the same time, the delivery stations (6) are adjustably mounted in the direction of rotation (41) and are connected to an adjustment device (27, 33). The adjustment device permits the angle of rotation (8) between the delivery apertures (7) of various stations (6) to be adjusted at the broad side of the rotor (1). This also enables the maximum possible weft insertion angle $\alpha$ with the greatest possible weft insertion velocity to be used even with a reduced loom width (36).

18 Claims, 9 Drawing Sheets

SERIES-SHED LOOM WITH ADJUSTABLE AIRJET DELIVERY SYSTEM FOR DIFFERENT LOOM WIDTHS

The invention relates to a rotor for a series-shed loom, in which relay system jets, which can be controlled with pulses of air, are installed along the weft ducts. A stationary constantly pressurized air distribution system is installed inside the rotor, said system comprising delivery stations distributed on axial sections along the rotor axis. Delivery apertures of the delivery stations are offset with respect to one another by an angle of rotation. Transfer apertures rotating past relative to the delivery stations supply air into supply ducts for relay system jets, while the cross sections overlap in order to produce a travelling field relative to the loom rotor.

BACKGROUND OF THE INVENTION

Such a loom rotor is shown in Steiner U.S. Pat. No. 4,586,541. A fixed switching tube having apertures in the shell surface closely abuts the cylindrical surface of a rotor and supplies air into bore holes in the cylindrical shell rotating past. The apertures in the switching tube lie on a helical line so that a travelling field is produced via the bore holes associated with one respective row of reeds, to which the relay system jets are connected. A disadvantage of this arrangement is that the travelling field is predetermined by the geometry of the switching tube. The maximum possible velocity for weft insertion can only be used with a determined loom width. With loom widths smaller than this, unused pauses between the individual weft beatups ups are produced with the maximum possible insertion velocity. The invention solves this problem.

SUMMARY OF THE INVENTION

The object of the invention is to use a determined weft insertion velocity, which is specified for a maximum loom width, with smaller loom widths as well by the reduction in time of the weft insertion resulting in a corresponding reduction in the weaving cycle.

A rotor for a series-shed loom is disclosed in which relay system jets controlled by pulses of air are installed. Installation of the relay jets occurs along the weft ducts. A stationary, constantly pressurized air distribution system is installed inside the rotor. The air distribution system includes delivery stations distributed on axial sections along the rotor axis. The delivery apertures of the air distribution system are offset with respect to one another by an angle of rotation of the rotor and transfer apertures rotating past the delivery apertures supply air into supply ducts for relay system jets. The delivery apertures of supplying adjacent sections overlap in order to produce adjoining travelling fields relative to the rotor. In the disclosed air delivery system, the delivery stations are connected to a least one group of relay system jets via a supply duct. The delivery stations are adjustably housed inside the rotor in the direction of rotation. An adjustment of the angle of rotation between the delivery apertures of various delivery stations is performed via adjustment devices at one or both of the sides of the rotor.

The advantages of the invention are regarded as being that the entire angle of rotation available for the weft insertion can be adjusted for a determined weft insertion velocity independently of the loom width.

Furthermore it is possible to optimize the blowing force and the helical line of the delivery apertures from outside when the series-shed loom is operating. At the delivery stations are produced only slight frictional forces independent of the blowing force of the relay system jets, which permit heat-insulating and lightweight materials such as relatively cheap plastics as wear-resistant sliding partners because of the low generation of heat.

BRIEF DESCRIPTION OF THE DRAWINGS

The invention is described below by means of exemplified embodiments.

DESCRIPTION OF THE PREFERRED EMBODIMENTS

In the figures for a series-shed loom are shown rotors having relay system jets, which inside the rotor are supplied with compressed air by an air distribution system via delivery stations distributed in the axial direction, in order to produce a travelling field relative to the rotor. At the same time the delivery stations, which supply a group of relay system jets via a supply duct, are adjustably housed in the direction of rotation and connected to an adjustment device, via which the angle of rotation between the delivery apertures of various delivery stations at the broad side of the rotor can be adjusted. Even with a shortened loom width this enables the use of the maximum possible weft insertion angle with the greatest possible weft insertion velocity.

Figure 1A:
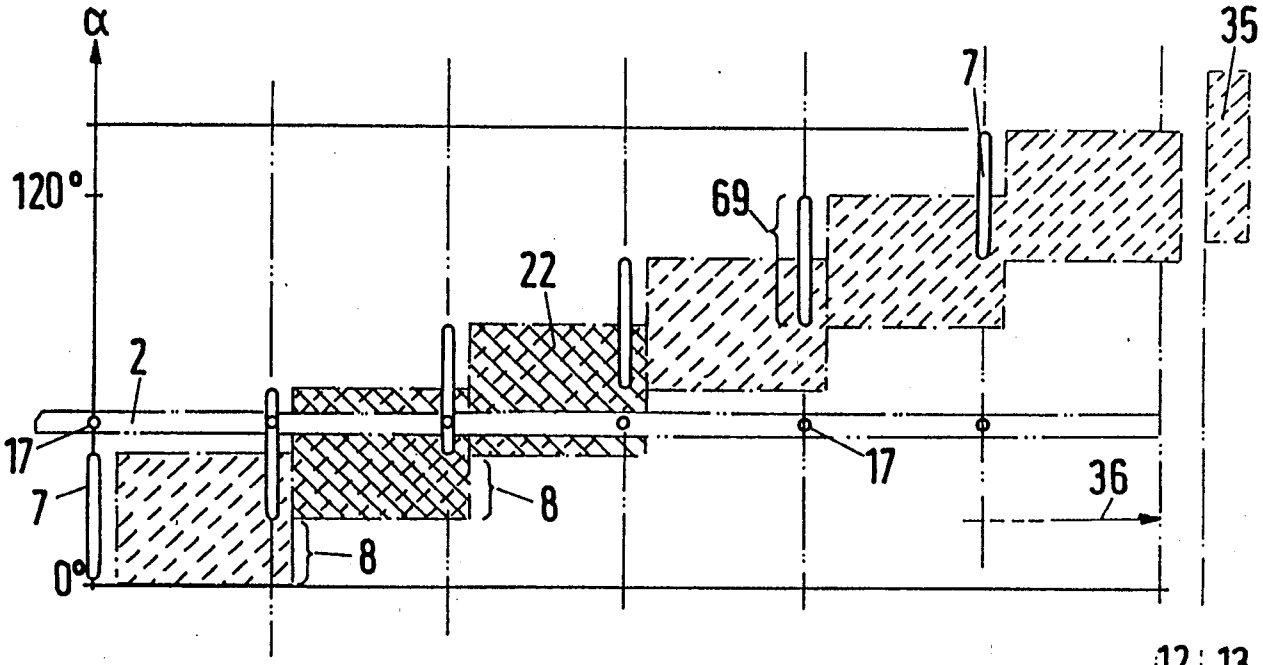
FIG. 1*a* diagrammatically shows how a travelling field is produced over the loom width for the weft insertion angle $\alpha$ as a development of a rotor, the overlap of delivery apertures by transfer apertures being diagrammatically superimposed.

In FIG. 1*a* a hatched travelling field 22 is applied over the loom width 36 for a loom rotor 1 and in dependence on the developed weft insertion angle $\alpha$ for a weft duct 2 of the rotor. On the same representation are projected delivery apertures 7 and transfer apertures 17, which, when they overlap, supply air to one group 31 of relay system jets 3 in the double hatched region of the travelling field for axial sections 4. Beneath FIG. 1*a*, in FIG. 1*b* the rotor 1 is diagrammatically shown in section over the loom width 36. Along its weft ducts 2 the rotor 1 is covered with relay system jets 3, which are assembled in groups 31. Each group 31 is supplied with compressed air on the inside of the rotor by an associated delivery station 6, all delivery stations being components of a constantly pressurized air distribution system 10. The delivery stations 6 are pivoted inside the rotor 1 and can be adjusted in the direction of. rotation via an adjustment device 33 on the broad side 73 and/or an adjustment device 27 (not shown here) on the opposite broad side 72, In this case the delivery stations 6 are supported with respect to one another in the direction of rotation and on the broad sides 72, 73 by torsion bar sections 9 and the air distribution system 10 connects the individual delivery stations 6 with hoses which can move in the direction of rotation, with a connecting hose being conveyed out of the hollow rotor 1 rotating in rotor bearings 67. A weft duct 2 formed in a row of reeds 37 is interrupted at the end of the loom width 36 by a cutting gap 34, in which a cutting device 12 is located, which limits the stretched weft thread to its final length. The stretching of the weft thread is performed with a stretching device 13 lying behind it, which produces a stretching field 35 shown in FIG. 1*a*. For each group 31 of relay system jets the delivery stations 6 comprise a delivery aperture 7 distorted in the direction of rotation, via which air is blown into transfer apertures 17 of the rotor 1 rotating past. The blowing time of the relay system jets 3 is determined by a blowing angle 69, to which the distortion of the delivery aperture 7 In the direction of rotation corresponds. The delivery apertures 7 of two adjacent delivery stations 6 are displaced with respect to one another by an angle of rotation 8 in the direction of rotation. With the adjustment devices 27, 33 the angle of rotation 8 between two adjacent delivery stations can be changed and the overall gradient of the travelling field 22 can be adapted to a new loom width in order to keep the weft insertion angle $\alpha$ constant irrespective of the loom width 36. This has the advantage that the rotor 1 can use the greatest possible weft insertion angle $\alpha$ with small loom widths 36 and can rotate more quickly so as to increase the number of picks.

Figure 1B:
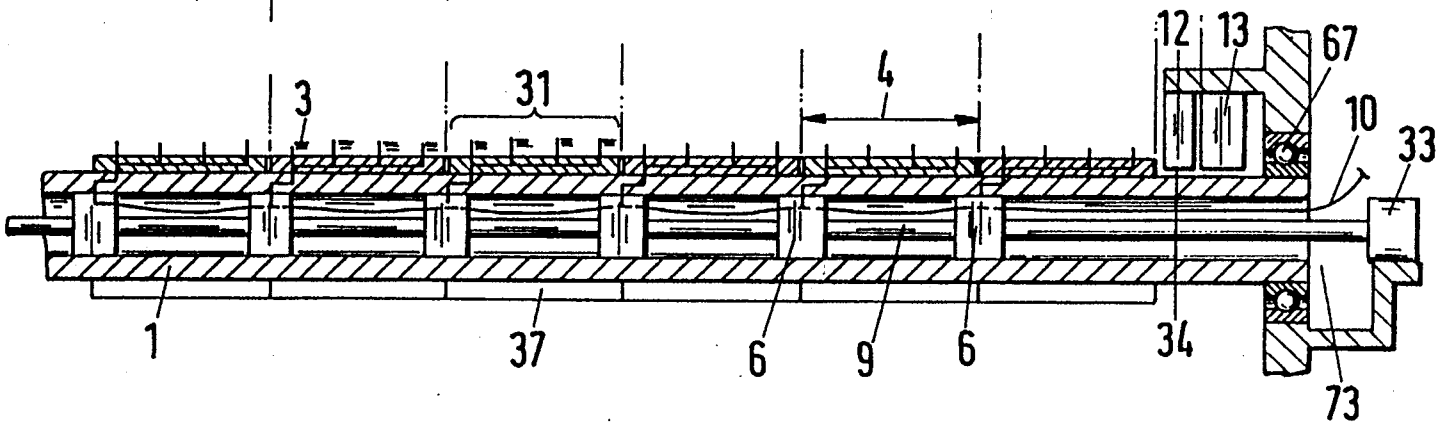
FIG. 1*b* diagrammatically shows a rotor corresponding to FIG. 1*a* having delivery stations and relay system jets to a weft duct.
Figure 2A:
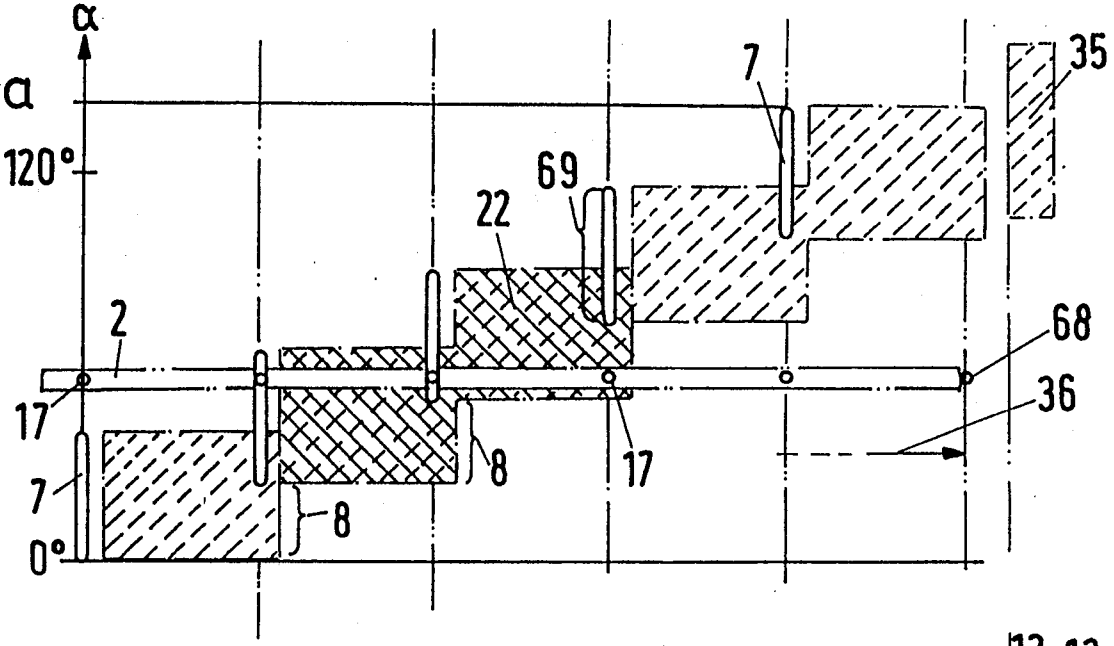
FIG. 2*a* diagrammatically shows as a development a travelling field for the same angle of rotation as in FIG. 1*a* but with a loom width reduced by the action of a delivery station.

In FIGS. 2*a, b* the loom width 36 was shortened for an embodiment as shown in FIGS. 1*a*, 1*b*, by the associated reeds 37 of the outermost delivery station 6 being removed from the rotor 1 and the stretching device 13 and the cutting device 12 being displaced inwards by the corresponding amount in the direction of the rotor axis. The associated transfer aperture 68 is blanked off. The original weft insertion angle $\alpha$ is achieved by an increase in the angle of rotation 8 between the adjacent delivery stations which can be adjusted in the direction of rotation. In the case of an adjustment via torsion bar sections 9, at the adjustment device 33 an adjustment of the outermost torsion bar section is performed in the direction of rotation and a larger torque is produced. The angles of rotation 8 between adjacent delivery stations 6 are increased according to the increase in the torque and the spring constants of the torsion bar sections 9. By this torsion the weft insertion angle is maintained and the reduction in the overlapping is regularly divided between the relevant groups 31 of relay system jets.

Figure 5:
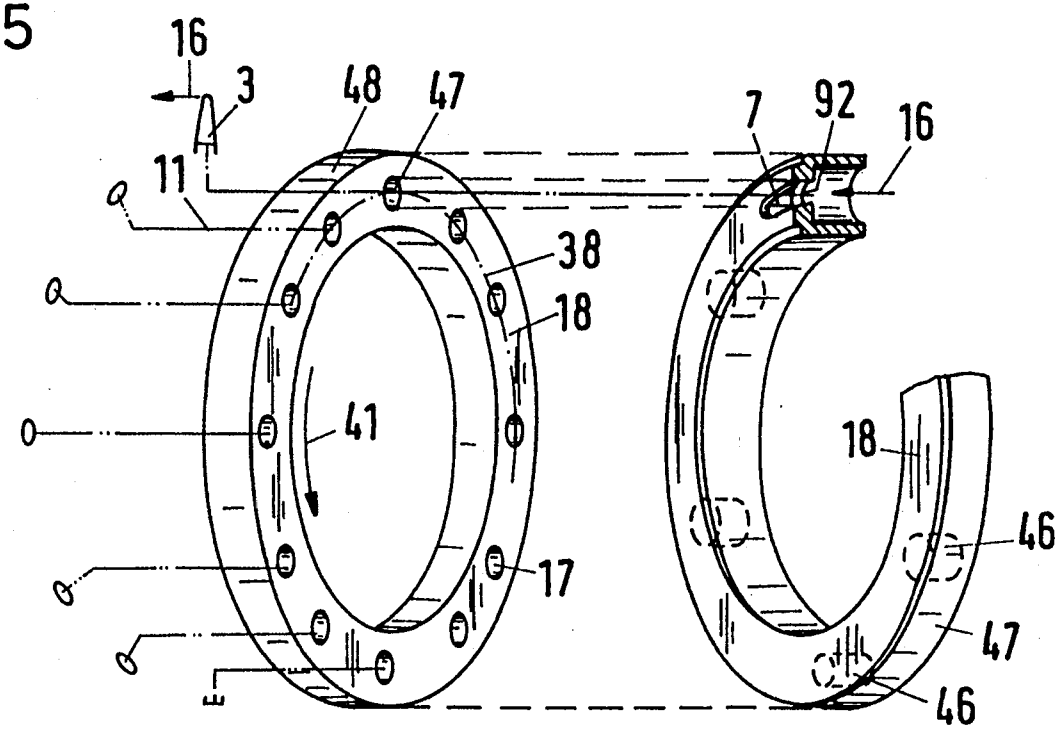
FIG. 5 diagrammatically shows an exploded view of a stationary delivery aperture and transfer apertures rotating past it with the rotor.
Figure 7:
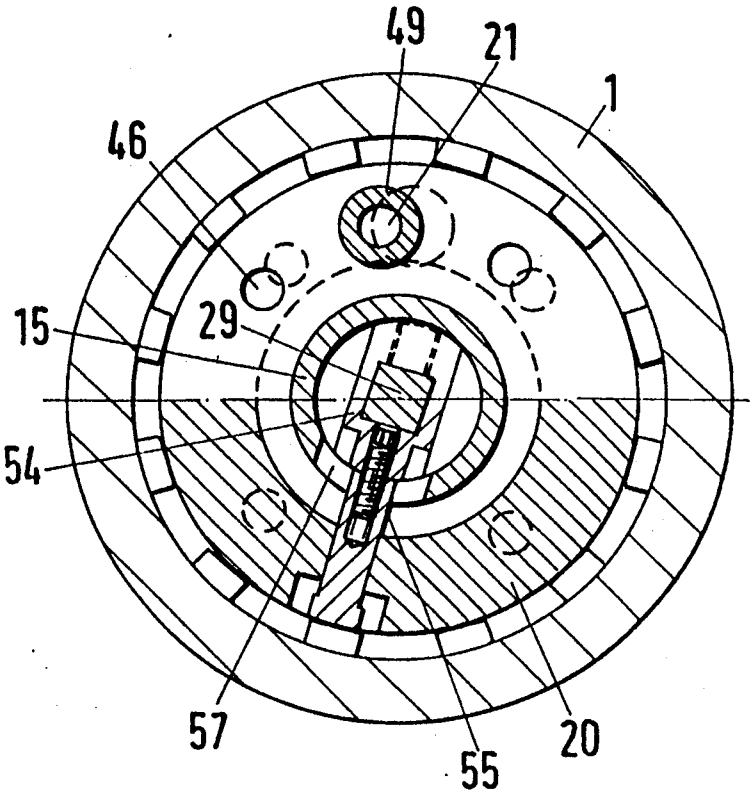
FIG. 7 diagrammatically shows an interrupted section VII in FIG. 3 at right angles to the axis of rotation through a delivery station.
Figure 6:
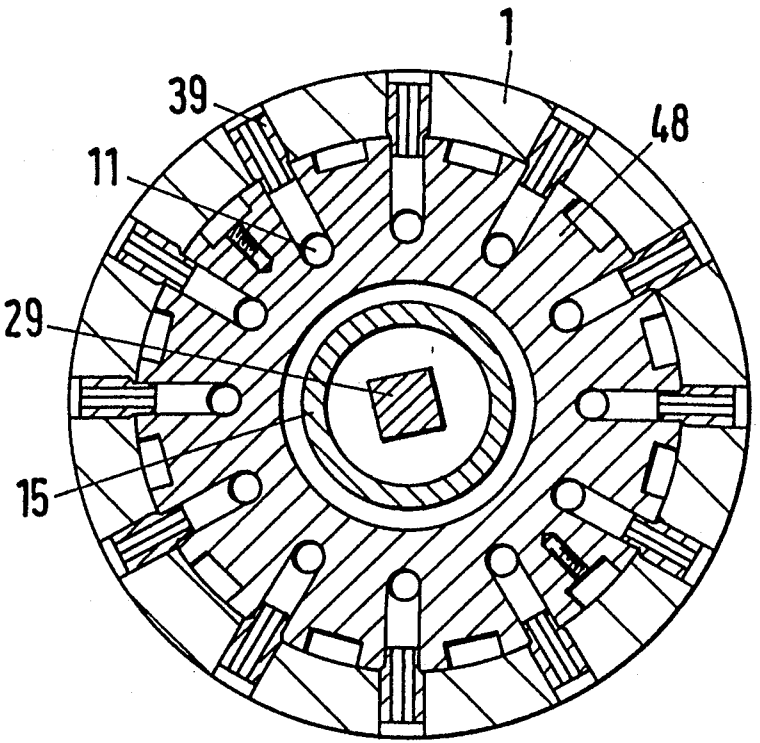
FIG. 6 diagrammatically shows a section VI in FIG. 3 at right angles to the axis of rotation, from which the distribution of the compressed air from the transfer apertures to the groups of relay system jets of the various weft ducts can be seen.

Irrespective of the type of adjustment for the delivery stations 6, said stations have to be prevented from unintentional torsion via a mechanical support at the broad sides 72, 73. Variations in the friction in the separating planes between the delivery aperture 7 and transfer apertures 17 act as disturbance variables on the angles of rotation 8. Furthermore with a plurality of delivery stations 6 is produced thermal output and power loss, which should be kept as low as possible. FIG. 5 shows a preferred arrangement for the transfer apertures 17 of a delivery station 6, which lie on a circle 38 in a separating plane 18, which is normal to the rotor axis 5 of the rotor 1. The transfer apertures 17 lie in the front face of a rotating annular member 48, which rotates connected with the rotor. The delivery aperture 7 distorted in the direction of rotation 41 lies in a stationary ring 47, which is constructed as a slip ring and with slight pressure abuts the rotating annular member 48. While the delivery and transfer apertures overlap, an air flow 16 is produced, which leads from a bore hole 92 via the separating plane 18 into the supply duct 11 to a group 31 of relay system jets 3. On its rear side the stationary ring 47 is provided with bore holes 46, which are intended for pressure springs 44 and a pin provided as rotation-preventing device 30. The pressure springs compensate for the positional tolerances in the front face of the rotating annular member 48.

Figure 3:
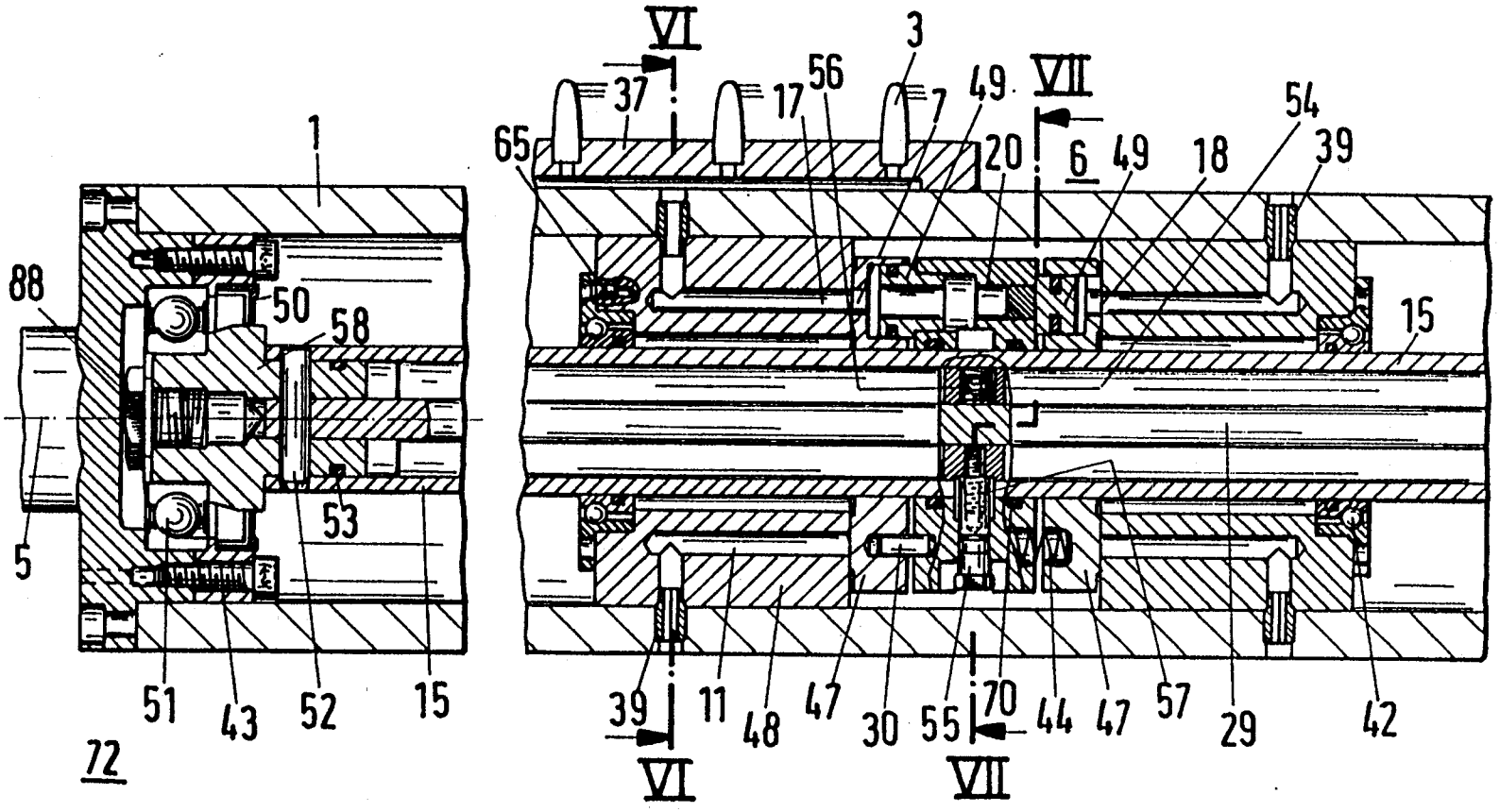
FIG. 3 diagrammatically shows a section along the axis of rotation of a rotor having a delivery station designed in duplicate.
Figure 8:
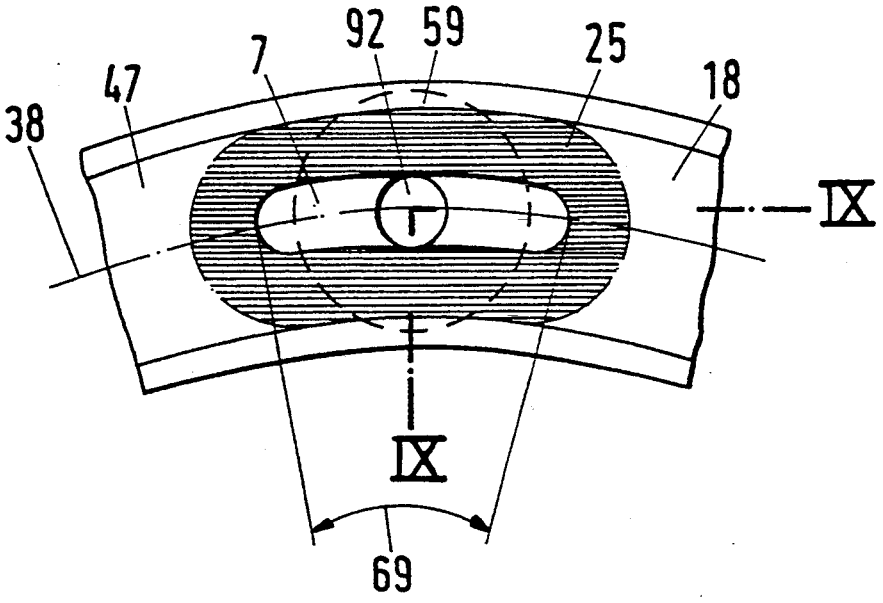
FIG. 8 diagrammatically shows the enlarged view of a stationary delivery aperture as shown in FIG. 5 with the sealing surface effective in the separating plane to the transfer apertures and the counter-surface lying behind it.
Figure 9:
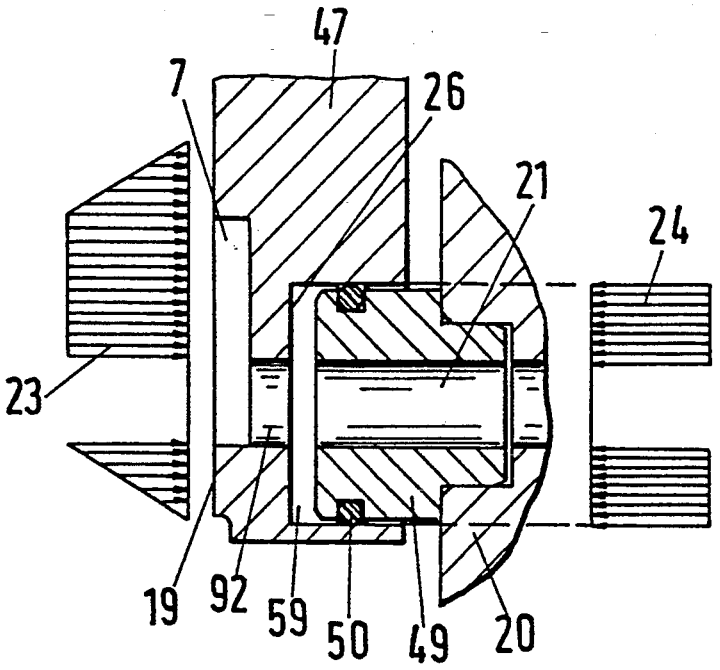
FIG. 9 diagrammatically shows a section IX through the delivery aperture in FIG. 8, from which the equilibrium of forces between the sealing surface and the counter-surface can be seen.

To reduce the friction between the rotating annular member 48 and the stationary ring 47 it would be advantageous to construct the pressure springs so that they are as weak as possible. This is opposed by the unequal pressure distribution on the front face of the stationary ring 47. The pressure in the sealing gap 19 along the delivery aperture 7 is substantially greater than in other regions of the front face and tries to position the stationary ring 47 obliquely. As this pressure can vary with the loom adjustment, a different spring support has only limited effectiveness. FIGS. 8 and 9 show a compensation of the air pressure-dependent opening force 23, which acts on the stationary ring 47 in an effective sealing surface 25, by on a counter-surface 26 the same air pressure producing a closing force 24, which roughly corresponds to the value of the opening force 23. The counter-surface 26 is incorporated as a front face of a cylinder bore 59 from the rear of the stationary ring 47, in which case on the cylindrical shell surface a piston 49 protruding from a support member 20 provides a seal with a soft seal 50 against the blowing pressure and permits axial displacements of the stationary ring 47. The blast air passes via a bore hole 21 in the piston 49 and via a bore hole 92 in the delivery aperture 7. The blowing angle 69 is determined by the distortion of the delivery aperture on the circle 38. In FIG. 3 is shown a double-action delivery station 6, in which to the left and to the right of a support member 20 is held an axially displaceable stationary ring 47 via pressure springs 44 and rotation-preventing device 30. The group of relay system jets is divided into a left-hand and a right-hand region, each of which is supplied with air by a piston 49. The two pistons 49 with the delivery apertures 7 are offset with respect to one another in the direction of rotation by a fixed amount and in addition form an intermediate stage in the travelling field. Each of the two stationary rings 47 has its own equilibrium of the pressure-dependent opening force 23 and closing force 24.

In FIGS. 3, 4, 6, 7 is shown a rotor, which comprises an air distribution system 10 having a pipe 15 concentrically housed in the rotor. The delivery stations 6 are pivoted with their support member 20 on the pipe 15, which is supported on the rotating annular member 48 for better guidance via bearings 42 with fixing device 65. For each row of reeds with weft duct 2, the annular members 48 rotating with the rotor possess a transfer aperture 17 with a connected supply duct 11 and a transition piece 39 to the relay system jets 3, which simultaneously seals and connects the rotating annular member 48 with respect to the rotor. The support member 20 is sealed with respect to the pipe 15 with two O-rings 70, which between them enclose a slit 57 in the pipe 15, and is displaceable in the direction of rotation.

Figure 4:
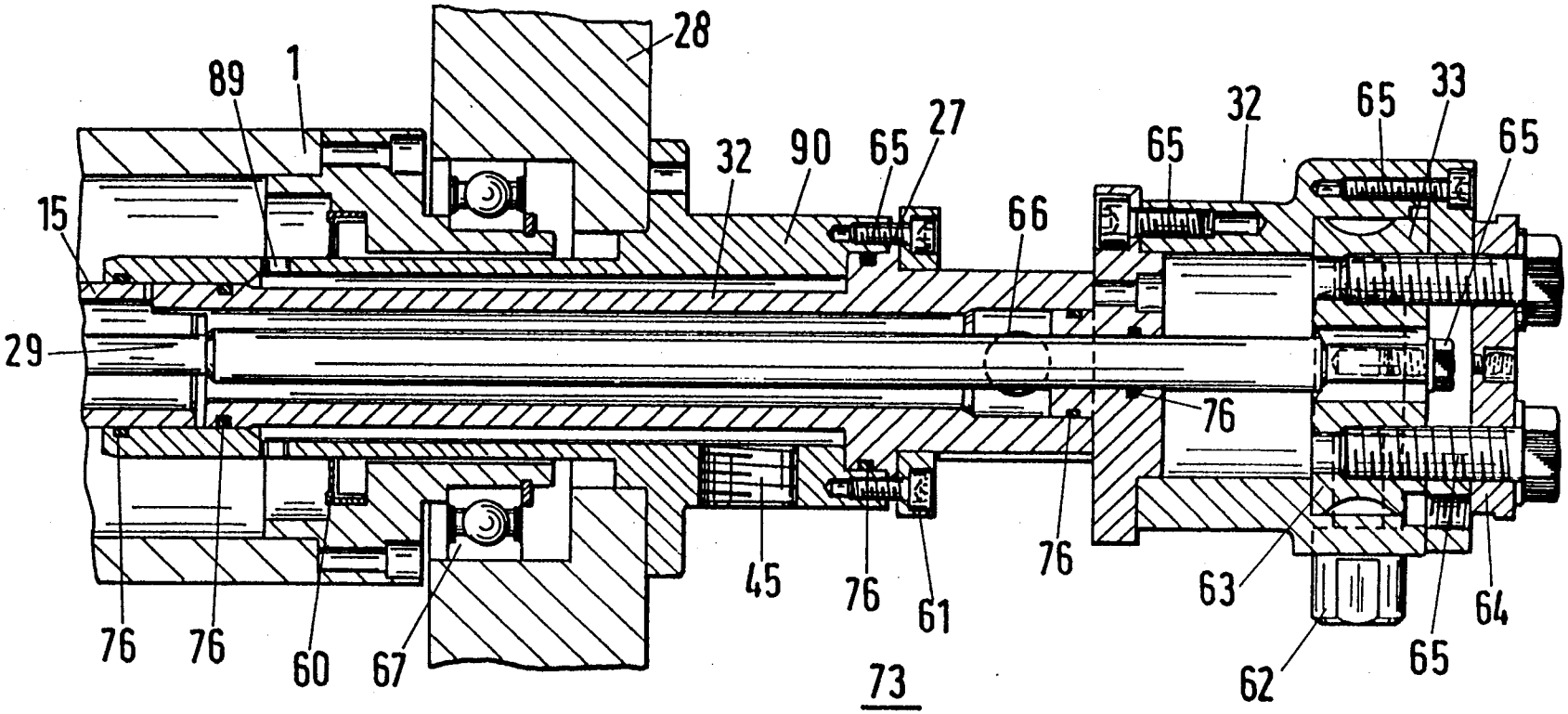
FIG. 4 diagrammatically shows a section along the axis of rotation of a rotor, from which the arrangement at one broad side of the rotor and an adjustment device for delivery stations can be seen.

The torsion bar sections 9 are assembled in a torque rod 29 having a quadratic cross section which is disposed concentrically in the pipe 15. The torsion of the torque rod 29 is transmitted to the support member 20 at each delivery station from a slide 54, which is mounted without play with an adjusting screw 56 on the torque rod, via a cam stud 55. In this case the slit 57 in the pipe 15 has sufficiently large dimensions so that a planned adjustment range can be performed in the direction of rotation and that a sufficiently free cross section from the pipe 15 is provided as an air passage to an annular groove between the O-rings 70 in order to supply the bore holes 21 in the pistons 49. The dimensions of the slides 54 are such that they can rotate in the pipe 15 and that they allow an adequate free cross section for the passage of air in the axial direction. In order to have adjustment devices 27, 33 on just one broad side 73, pipe 15 and torque rod 29 are connected to one another so they can not rotate on the other broad side 72 inside the rotor 1. FIG. 3 shows this connection via a coupling 58, which is supported via a bearing 51 in the rotor 1 and which closes the pipe 15 at its end with an O-ring 53 and a screw plug 88 so that it is air-tight. The actual rotationally secure connection is performed via a pin 52. At the bearing 51 is shown a soft seal 50 and a bearing retention device 43. The pipe 15, which is substantially more torsionally rigid than the torque rod 29, is used as mechanical transmission on the broad side 73 as shown in FIG. 4 in order to transmit a twisting movement via a separator 32 from a first adjustment device 27, while a further twisting movement is performed on the same broad side 73 via a second adjustment device 33 at the other end of the torque rod 29. Both adjustment devices 27, 33 and pipe 15 with separator 32 are attached to the housing 28 via a sleeve 93. Independently therefrom the rotor 1 is supported via a rotor bearing 67 in the housing 28. O-rings 76 and a soft seal 60 ensure that compressed air is introduced into the pipe 15 via connecting aperture 66 without any leakage and that the leakage air from the delivery stations 6 is collected inside the rotor 1 and conveyed to the outside via bore holes 89 and outlet aperture 45. The first adjustment device 27 consists of a clamping flange 61, which after torsion is tightened by the separator 32. In the case of the second adjustment device 33 the torsion is performed via worm 62 and worm wheel 63 at the torque rod 29 and then secured with clamping flange 64. The necessary screw fittings are designated by 65.

Figure 10:
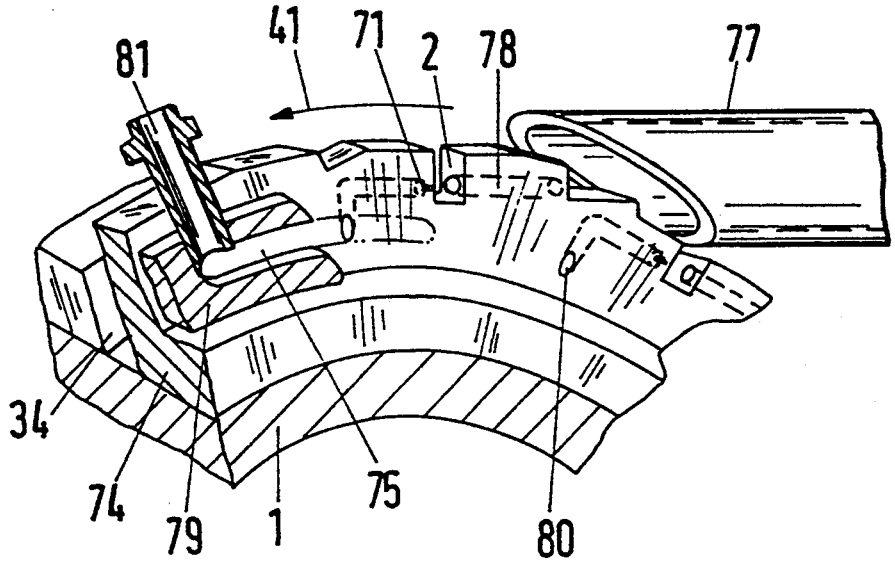
FIG. 10 diagrammatically shows a detail of a stretching device at the weft outlet side, in which stretching nozzles similar to injectors, which rotate with the rotor at right angles to the weft duct on a ring, are supplied with compressed air by a stationary air supply, and FIG. 11 diagrammatically shows a section along the rotor axis of a rotor through an axially displaceable stretching device, in which the stationary air supply is centered via a double spring ring axially between two rotating rings.
Figure 11:
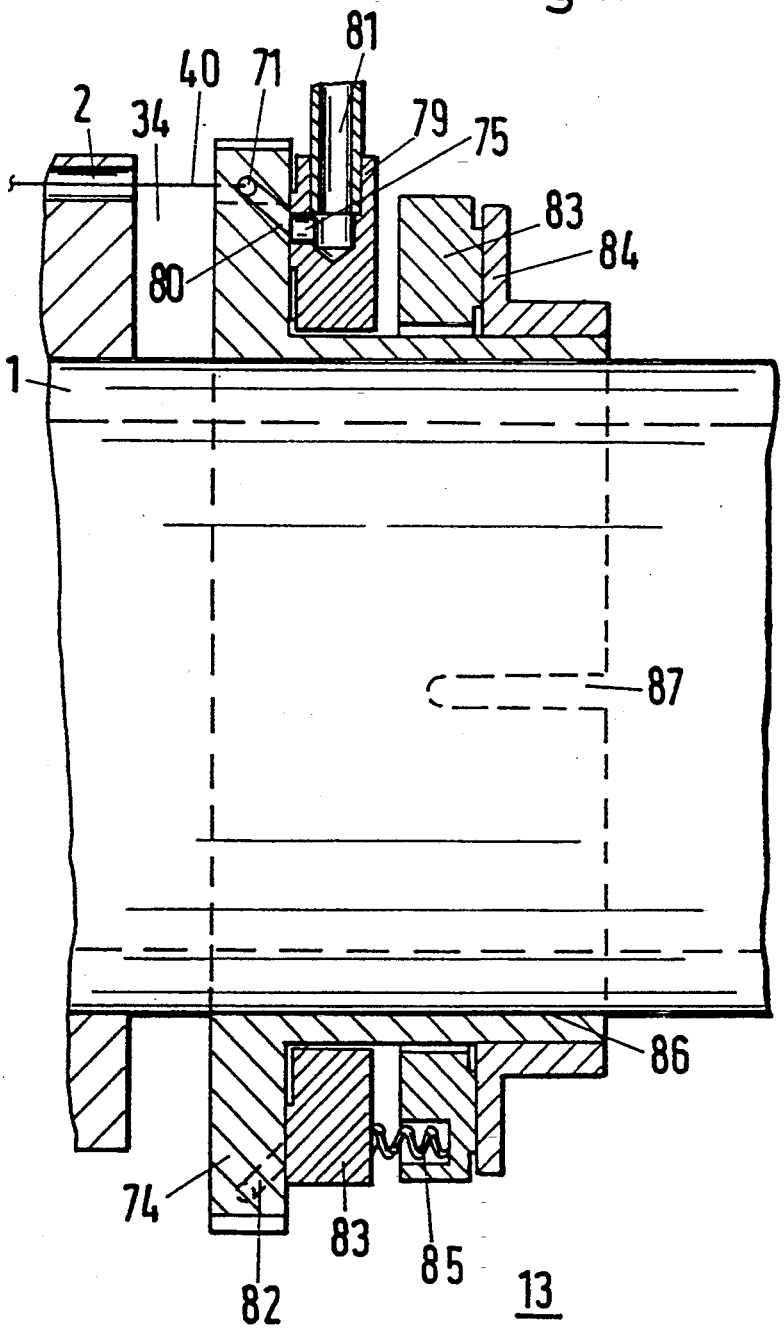

In FIGS. 10 and 11 is shown an axially adjustable stretching device 13. A ring 74 which rotates with the rotor 1 and is axially displaceable is secured at a distance from the cutting gap 34 on the rotor with attachment elements 87, e.g. locking screws. The weft ducts 2 interrupted by the cutting gap 34 are continued in this ring 74, the ring 74 comprising at right angles to each weft duct 2 a stretching nozzle 71, which is similar to an injector and is interrupted by the weft duct, and which deflects the tip of the weft thread whilst maintaining a stretching force at right angles to the weft duct and stretches the weft thread 40 before introduction into a cutting device and blows the tip of weft thread cut off through a nozzle half constructed as a doffing duct 78 into a stationary collecting device 77. On the side remote from the cutting gap 34, the ring 74 possesses a front face normal to the rotor axis in which for every stretching nozzle 71 an inclined bore 82 ends with a transfer aperture 80. The transfer apertures 80 have an equal distance to the rotor axis 5 and as they rotate past are supplied with compressed air from a stationary air supply 79 via a delivery aperture 75 distorted in the direction of rotation 41 whilst they overlap. Such a stretching device 13 can also be designed without a cutting device 12 in order to stretch the weft thread 40 before knock-up at the fabric, in which case a cutting gap 34 can be omitted.

Figure 2B:
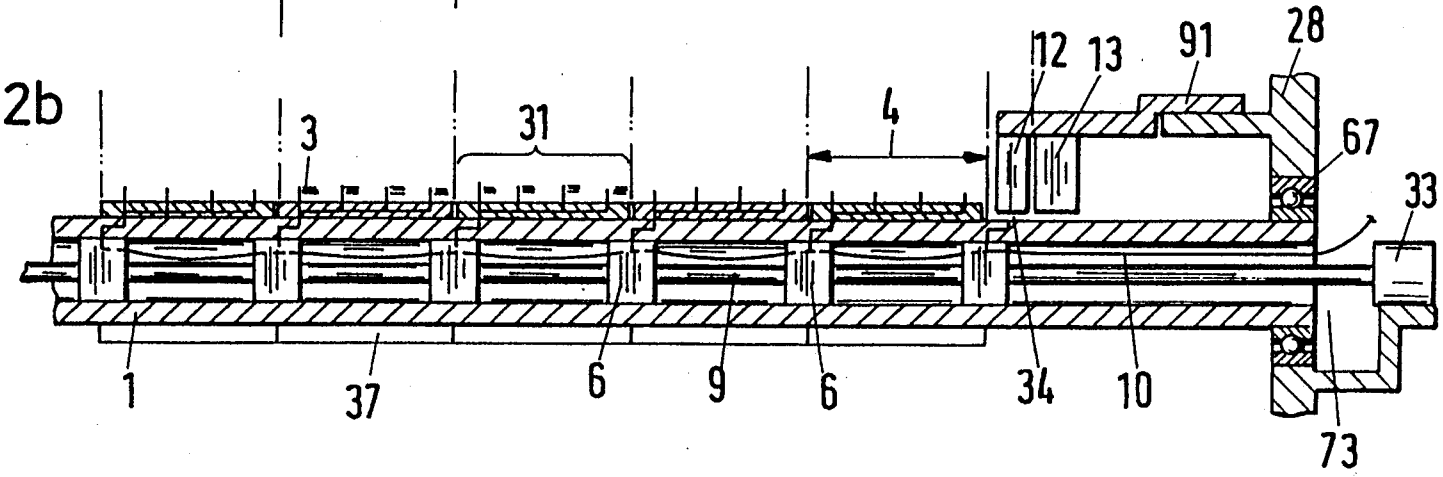
FIG. 2*b* diagrammatically shows the rotor corresponding to FIG. 2*a*, in which the weft duct was shortened over a smaller loom width.

In FIG. 11 is shown an embodiment in which the stationary air supply 79 is performed via a compressed air connection 81 at a first bearing race, which is braced with a second bearing race via helical springs 85 to form a pair of rings 83 between the ring 74 and a counter-ring 84 attached thereon. Air supply 79 and the pair of rings 83 are prevented from twisting via an axially displaceable bracket 91 connected to the housing 29 (see FIG. 2*b*). This arrangement with the pair of rings 83 has, as with the delivery stations 6, the advantage that the high-grade friction surfaces, which comprise delivery and transfer apertures, are covered by a counter-surface of the same size to keep the risk of soiling and wear small. A ramp for dirt particles can only be provided at the delivery and transfer apertures, but this does not promote wear, as only conditioned and pressurised air flow through the latter.

The pressure-independent force equilibrium at the delivery stations 6 and the low risk of soiling also permit the use of plastic as a material for sliding rings.

I claim:

1. A rotor having sides at either end and rotatable about a rotor axis in a direction of rotor rotation on a series-shed loom, said rotor having weft ducts for the placement of weft threads in cloth being woven, said rotor further having;

relay system jets installed along the weft ducts for introducing said weft threads controlled by pulses of air;

a stationary, constantly pressurized air distribution system being installed inside the rotor;

said stationary, constantly pressurized air distribution system comprising delivery stations distributed on axial sections on said rotor along said rotor axis;

said delivery stations including:

delivery apertures on said rotor offset with respect to one another by an angle of rotation of said rotor;

supply ducts for introducing air into said relay system jets;

transfer apertures rotating past said delivery apertures for supplying air into said supply ducts for said relay system jets;

said transfer apertures rotating past said delivery apertures of adjacent axial sections of said rotor having overlapped travelling fields relative to the rotor, whereby said relay system jets of adjacent delivery stations to adjacent axial sections of said rotor have overlapped travelling fields of actuation of said relay system jets relative to rotation of said rotor;

the improvement comprising:

said delivery stations are connected to a least one group of relay system jets via a supply duct;

said delivery stations adapted to be adjustably housed inside the rotor in said direction of rotor rotation; and, means for providing an adjustment of said angle of rotation of said delivery apertures of various delivery stations; and, an adjustment device at at least one side of the rotor operatively connected to said means for providing an adjustment of the angle of rotation of said delivery apertures.

2. A rotor according to claim 1 further including:

said stationary, constantly pressurized air distribution system comprises a pipe concentrically housed in said rotor, on which said delivery stations are pivoted and from which said delivery stations are also supplied with air;

said means for providing an adjustment of the angle of rotation between said delivery apertures with respect to one another includes slits extending in said direction of rotation.

3. A rotor according to claim 2 further including:

said delivery stations being connected to one another over the width of the rotor by torsion bar sections;

whereby applied torque to said torsion bar sections effect an alteration in the angle of rotation between said delivery apertures of different delivery stations.

4. A rotor according to claim 3 further including:

said torsion bar sections are connected to a continuous torque rod housed concentrically in said rotor; and, said delivery stations are connected securely with respect to said continuous torque rod against rotation.

5. A rotor according to claim 4 further including:

said air distribution system includes a pipe;

said torque rod and said pipe are connected rigidly to one another on one side of said rotor and on the other side of said rotor can be twisted with respect to one another by said adjustment device.

6. A rotor according to claim 1 further including:

said delivery apertures are adapted to be stationary and said transfer apertures are adapted to relatively rotate with respect to said delivery apertures; and, said delivery apertures are positioned with said rotor offset so as to touch said transfer apertures in a separating plane inside of said rotor which is normal to said rotor axis whereby said overlapped travelling fields are produced temporarily during said rotor rotation.

7. A rotor according to claim 6 further wherein:

two groups of relay system jets are supplied by two groups of delivery apertures from one delivery station;

said two groups of delivery apertures being displaced with respect to one another by an angle of rotation which corresponds to an angle of rotation of said rotor occupied by said overlapped travelling fields in said direction of rotor rotation.

8. A rotor according to claim 6 further including:

said rotor includes rows of reeds on said rotor;

said delivery apertures and said transfer apertures associated to a row of reeds lie on a common circle in a separating plane normal to said rotor axis and in that said delivery aperture occupies a larger angular region than a transfer aperture on this said common circle.

9. A rotor according to claim 6 further including:

an opening force exerted by air pressure between said delivery Apertures and said transfer apertures at said separating plane;

a counter surface disposed between said delivery and transfer apertures at a stationary ring adjoining said separating plane; and, a closing force acting by air pressure opposite to said opening force exerted through said counter surface between the delivery and transfer apertures.

10. A rotor according to claim 9 further including:

said counter surface is surrounded by a cylinder/piston seal adjacent a delivery station.

11. A rotor according to claim 1 further including:

said delivery apertures are adapted to be movably housed with respect to said transfer apertures and are moveable by elastic force.

12. A rotor according to claim 1 further including:

said weft ducts include an outlet side;

said outlet side of said weft ducts permitting the passage of threads from the series shed;

sections of said weft ducts are adapted to be detachably attached to said relay system jets;

said supply ducts for said detachably attached relay system jets are closeable in order to use remaining delivery stations for a reduced loom width.

13. A rotor according to claim 1 further including:

said rotor has a weft outlet side;

said rotor on said weft outlet side possesses a stretching device for the tips of weft thread;

said stretching device comprising a ring rotating with the rotor at right angles to each weft duct;

a stretching nozzle interrupted by the weft duct;

a stationary air supply with a delivery aperture on said ring to supply compressed air to said stretching nozzle.

14. A rotor according to claim 13 further including:

a weft thread end collecting device;

a cutting gap placed in front of the stretching nozzles at right angles to said weft ducts, said cutting gap for the installation of a stationary cutting device in order to separate ends of the stretched weft threads;

said stretching nozzles aligned to blow said weft thread ends into said collecting device.

15. A rotor according to claim 14 further including:

means for axial displacement of said ring rotating with the rotor and said stationary air supply to enable function of said stretching device at varying rotor axial locations of said ring on said rotor.

16. A rotor according to claim 14 further including:

said stationary air supply consists of a pair of rings consisting of a rotating ring and a counter-ring which is adjacent to the rotating ring.

17. A method of adjusting a rotor, said rotor having one side at either end and rotatable about a rotor axis in a direction of rotation on a series-shed loom, said rotor further having weft ducts for the placement of weft threads in cloth being woven, said rotor comprising:

relay system jets installed along said weft ducts for introducing said weft threads controlled by pulses of air through said relay system jets;

a stationary, constantly pressurized air distribution system being installed inside said rotor;

said stationary, constantly pressurized air distribution system comprising delivery stations distributed on axial sections on said rotor along said rotor axis;

said delivery stations including:

delivery apertures on said rotor offset with respect to one another by an angle of rotation of said rotor;

supply ducts for introducing air into said relay system jets;

transfer apertures rotating past said delivery apertures for supplying air into said supply ducts for said relay system jets;

said transfer apertures rotating past said delivery apertures of adjacent axial sections of said rotor having overlapped travelling fields relative to the rotor, whereby said relay system jets of adjacent delivery stations to adjacent axial sections of said rotor have overlapped travelling fields of actuation of said relay system jets relative to rotation of said rotor;

the method of adjusting said rotor comprising the steps of:

adjustably housing said delivery stations in said direction of rotor rotation inside said rotor; and, providing an adjustment of the angle of rotation between said delivery apertures of various delivery stations and said transfer apertures including adjustment devices at at least one said side of the rotor.

18. A method of adjusting rotor according to claim 17 comprising the further step of:

attaching said delivery stations to a torsion bar extending from one side of said rotor to the opposite side of said rotor; and, said providing an adjustment of the angle step includes adjusting the torsion on said torsion bar from at least one side of said rotor.

* * * * *